United States Patent [19]

Brown

[11] 3,959,991

[45] June 1, 1976

[54] CIRCULAR KNITTING MACHINE WITH CANTILEVERED, PIVOTALLY MOUNTED PLATFORM

[75] Inventor: Robert Saul Brown, Spartanburg, S.C.

[73] Assignee: Deering Milliken Research Corporation, Spartanburg, S.C.

[22] Filed: Apr. 16, 1975

[21] Appl. No.: 568,669

[52] U.S. Cl. ..... 66/8; 66/1 R; 312/235 R; 108/48

[51] Int. Cl.[2] ..... D04B 9/00

[58] Field of Search ..... 66/8, 1 R, 147, 149 R, 66/151, 60 R, 64, 60 H; 139/13, 1 R, 304; 297/217, 331, 334, 335; 312/228, 235 R; 108/50, 48

[56] References Cited

UNITED STATES PATENTS

| | | | |
|---|---|---|---|
| 622,647 | 4/1899 | Davis | 297/331 X |
| 1,520,579 | 12/1924 | Knutson et al. | 108/50 |
| 1,712,126 | 5/1929 | Taylor | 108/50 |
| 2,488,222 | 11/1949 | Morgan | 312/235 R |
| 2,751,768 | 6/1956 | Lebocey | 66/149 R X |
| 3,341,148 | 9/1967 | Cooper | 139/304 |
| 3,590,599 | 7/1971 | Ricart | 66/8 |
| 3,779,041 | 12/1973 | Gati | 66/147 X |
| 3,839,885 | 10/1974 | Bourgeois | 66/151 |
| 3,842,627 | 10/1974 | Bassist | 66/151 |
| 3,850,012 | 11/1974 | Bourgeois | 66/151 |
| 3,855,822 | 12/1974 | Lee | 66/151 |

FOREIGN PATENTS OR APPLICATIONS

| | | | |
|---|---|---|---|
| 537,357 | 4/1953 | Canada | 312/235 |
| 879,983 | 10/1961 | United Kingdom | 139/13 |
| 1,132,170 | 10/1968 | United Kingdom | 139/1 R |
| 851,385 | 10/1960 | United Kingdom | 312/235 |

*Primary Examiner*—Mervin Stein
*Assistant Examiner*—Andrew M. Falik
*Attorney, Agent, or Firm*—H. William Petry

[57] ABSTRACT

A circular knitting machine having cantilevered split steps attached to the machine which are accessible when the machine is in operation but are moved out of the way when the knitting machine is opened to gain access to the interior of the machine.

4 Claims, 4 Drawing Figures

CIRCULAR KNITTING MACHINE WITH CANTILEVERED, PIVOTALLY MOUNTED PLATFORM

The object of the invention is to provide a step on a circular knitting machine for use by an operator when the machine is in use but which is readily moved out of the way when it is necessary to gain entrance to the interior of the machine.

Other objects and advantages of the invention will become clearly apparent as the spcecification proceeds to describe the invention with reference to the accompanying drawings, in which.

Figure 1:
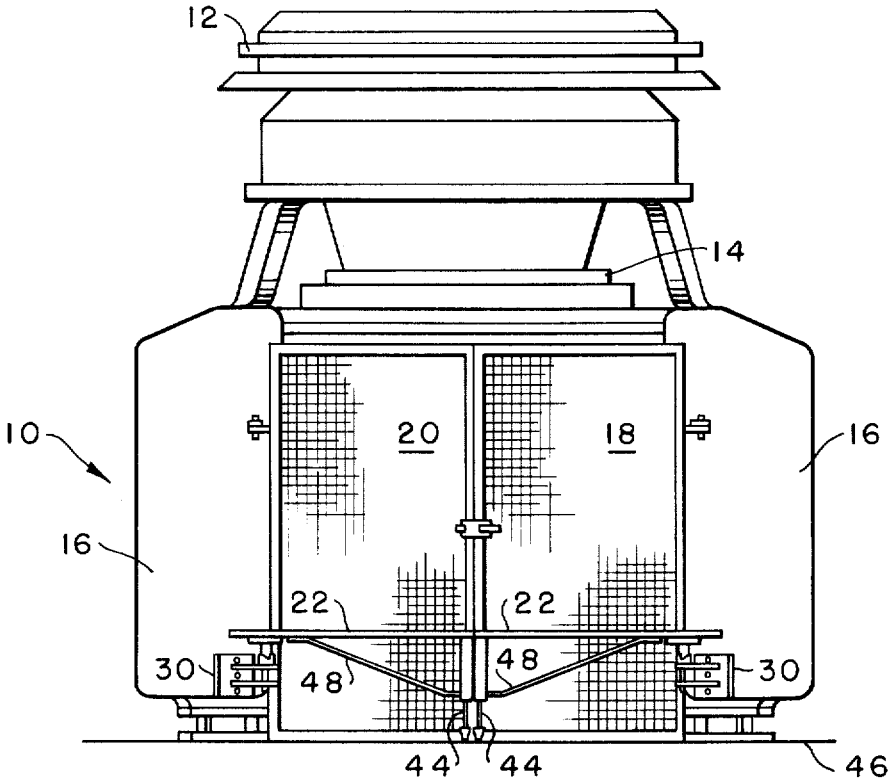
FIG. 1 is a schematic front elevation view of a circular knitting machine which employs a step for use by the machine operator.

Looking to FIG. 1, the reference numeral 10 represents a conventional circular knitting machine which is supplied with a plurality of yarns from an off-side creel (not shown). The yarn is supplied through the yarn guide ring 12 to the rotating needle cylinder 14 whereat it is knit into a tube of fabric and taken up on a take-up roll located inside the machine. The knitting machine employs a plurality of frame members 16 between which are hinged a pair of screen guard doors 18 and 20 to prevent access to the interior of the machine during operation.

To gain access to the upper portions of the machine 10, a plurality of cantilevered arcuate platforms 22 are mounted to the frame members 16 outside of the doors 18 and 20 by means of a shaft 24 which is rotably supported in support plates 26 and 28 connected to plate 30. Connected to the shaft 24 is a follower rod 32 which engages the cam surface 34 of the collar 36 for reasons hereinafter explained. A pair of angle iron members 38 and 40 are connected to the bottom of the outer end of the platform 22 at one end and support a plate 42 at the other end. Plate 42 has a plurality of legs 44 connected thereto to engage the floor surface 46 when in the position shown in FIGS. 1 and 2. A support member 48 is connected to the bottom of platform 22 at one end and plate 42 at the other end for rigidity.

Figure 2:
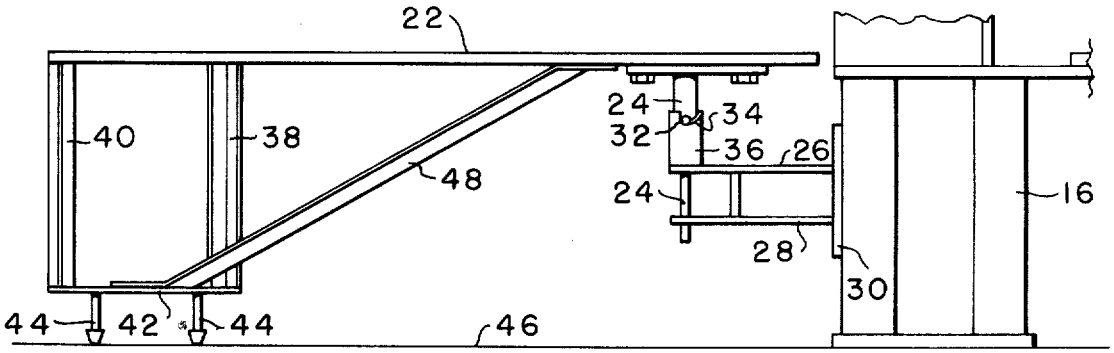
FIG. 2 is a front blown-up elevation view of one of the steps taken on lines 2–3 of FIG. 4.
Figure 3:
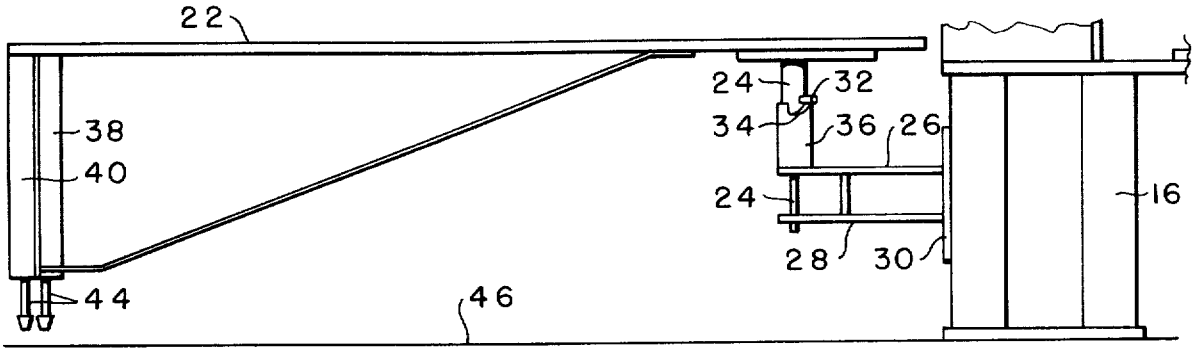
FIG. 3 is a view similar to FIG. 2 showing the step as it is when pivoted out of operative relationship with the machine.
Figure 4:
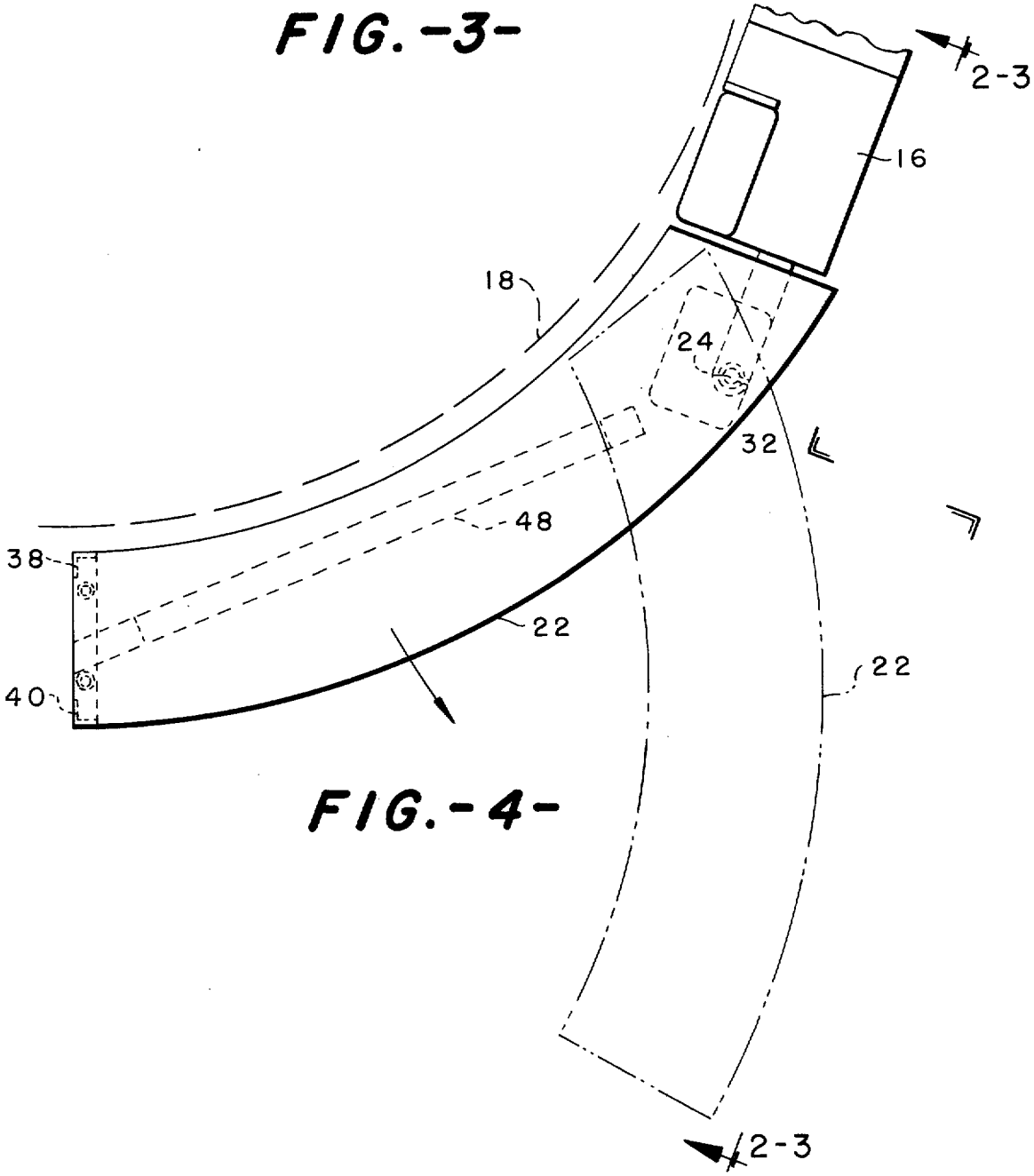
FIG. 4 is a schematic top view of one of the steps showing the step in operative and inoperative positions.

When the knitting machine 10 is operating normally and the doors 18 and 20 are closed, the platform is in the position shown in FIGS. 1 and 2 and in solid lines in FIG. 4. In this position the legs 44 are on the floor 46 and the cam follower is in the bottom of the cam surface 34 as shown in FIG. 2. Then when it is desired to gain access to the interior of the machine, the platform is rotated in the direction of the arrow in FIG. 4. As the platform is being rotated the cam 32 will ride up the cam surface 34 to cause the legs 44 to lift off the floor 46 to eliminate dragging of the legs 44 on the floor surface to thereby reduce the amount of force necessary to rotate the platform. As can be seen, when the platform reaches the dotted line position shown in FIG. 4 the doors 18 and 20 can be opened and the interior of the knitting machine 10 is readily accessible.

It can be seen that a step or platform construction has been provided for a circular knitting machine that is efficient in use and can be readily moved to an inoperative position when it is necessary to gain access to the interior of the knitting machine.

Although the preferred embodiment of the invention has been described, it is contemplated that changes may be made without departing from the scope or spirit of the invention and it is desired that the invention be limited only by the scope of the claims.

That which is claimed is:

1. A circular knitting machine having a frame and a means to knit a circular fabric comprising: a platform pivotally mounted to said frame substantially perpendicular to the vertical axis of said knitting machine and means to allow horizontal pivotal movement of said platform, said platform including legs adapted to contact the surface on which said machine is mounted when said platform is adjacent said machine.

2. The structure of claim 1 wherein said means to allow horizontal pivotal movement includes a cam means to cause said platform to be raised to raise said legs when said platform is pivoted outwardly from said machine.

3. The structure of claim 2 wherein said cam means includes a cam connected to said frame and a cam follower connected to said platform.

4. The structure of claim 3 wherein said cam is a collar member with a portion of the wall thereof cut out to accommodate said cam follower.

* * * * *